United States Patent [19]

Nishikawa et al.

[11] Patent Number: 4,979,983

[45] Date of Patent: Dec. 25, 1990

[54] PROCESS FOR VACUUM DEGASSING AND DECARBONIZATION WITH TEMPERATURE DROP COMPENSATING FEATURE

[75] Inventors: Hiroshi Nishikawa; Kyoichi Kameyama; Ryuichi Asaho, all of Chiba, Japan

[73] Assignee: Kawasaki Steel Corporation, Kobe, Japan

[21] Appl. No.: 369,269

[22] Filed: Jun. 21, 1989

[30] Foreign Application Priority Data

Jun. 21, 1988 [JP] Japan ..... 63-151175

[51] Int. Cl.[5] ..... C21C 7/10

[52] U.S. Cl. ..... 75/511; 75/512

[58] Field of Search ..... 75/49, 59.18

[56] References Cited

U.S. PATENT DOCUMENTS

| | | | |
|---|---|---|---|
| 3,497,196 | 2/1975 | Ruttiger | 266/208 |
| 4,160,664 | 7/1979 | Maruhashi | 75/49 |
| 4,615,511 | 10/1986 | Sherwood | 75/49 |

OTHER PUBLICATIONS

Patent Abstracts of Japan, vol. 4, No. 98(C-18)[580], Jul. 15, 1980, p. 163 C 18; & JP-A-55 062 118 (Kawasaki Seitetsu K.K.), 10-05-1980.

Patent Abstracts of Japan, vol. 8, No. 168, (C-236)[1605], Aug. 3, 1984; & JP-A-59 067 310 (Shin Nippon Seitetsu K.K.), 17-04-1984, (CatA).

Patent Abstracts of Japan, vol. 4, No. 186, (C-36)[668], Dec. 20, 1980; & JP-A-55 125 220, (Sumitomo Kinzoku Kogyo K.K.), 26-09-1980, (Cat. A).

*Primary Examiner*—Peter D. Rosenberg

*Attorney, Agent, or Firm*—Dvorak and Traub

[57] ABSTRACT

A process of degassing and decarbonizing is directed to a process for performing vacuum degassing non-deoxidized or slightly deoxidized molten steel utilizing RH process or DH process. The process includes blowing of oxygen or oxygen containing gas toward the surface of the molten steel in a vacuum chamber for promoting decarbonizing reaction. The process further includes a step of combustioning of CO gas in the vicinity of the surface of the molten metal at a timing, in which concentration of ($CO+CO_2$) in an exhaust gas is higher than or equal to 5% and a ratio of $CO_2$ versus ($CO+CO_2$) in the exhaust gas is approximately 30%. Heat generated by combustioning of CO gas is utilized for compensating temperature drop of the molten steel.

8 Claims, 6 Drawing Sheets

PROCESS FOR VACUUM DEGASSING AND DECARBONIZATION WITH TEMPERATURE DROP COMPENSATING FEATURE

BACKGROUND OF THE INVENTION

1. Field of the Invention

The present invention relates generally to a process for vacuum degassing and decarbonization of molten steel, such as closed circuit vacuum degassing process Ruhrstahl Hausen (RH) process, RH-OB process and so forth. More specifically, the invention relates to a technology of temperature compensation in vacuum degassing and decarbonization process.

2. Description of the Background Art

Japanese Patent First (unexamined) Publication (Tokkai) Showa 52-5614 discloses RH process for performing decarbonization under vacuum pressure. On the other hand, Japanese Patent First Publication (Tokkai) Showa 51-140815 discloses a technology of injecting oxygen gas into a molten steel bath through a side wall of a ladle. The later technology is explained to be particularly applicable for decarbonization in production of high chromium steel. Another technology has already proposed in Japanese Patent First Publication (Tokkai) Showa 47-17619, in which a solid phase oxygen is added as decarbonization promoting agent. Furthermore, Japanese Patent First Publication (Tokkai) Showa 55-125220 discloses decarbonization technology of top blowing by means of lance with Laval nozzle. These prior proposed technologies are effective for promoting decarbonization. However, non of these can solve a problem of temperature drop of the melt caused during degassing and/or decarbonization process.

It is the conventional practice to provisionally heating melt at a temperature higher than necessary temperature so as to compensate temperature drop during decarbonization process. In such conventional approach, a problem is encountered by higher temperature of the melt. Namely, when the temperature of the melt is to be risen about the necessary temperature in a primary furnace, such as a converter, refractory on a smelting furnace and ladle will be subject substantial heat to cause melting.

On the other hand, Iron and Steel No. 11, Vol. 64(1978)S 635 shows RH-OB process for heating the melt during vacuum degassing process. Also, Japanese Patent First Publications 53-81416 and 59-89708 disclose a technologies of heating the melt by adding heat generating material, such as Al, Si and so forth to the melt in the vacuum chamber or in the ladle and injecting oxygen gas to the heat generating material containing melt.

The following is one of typical process for actually implementing degassing and decarbonization process to utilize the foregoing methods set forth above in combination. In such actually implemented process, (1) a molten steel for which deoxidation process is not performed, is subject decarbonization process for removing or reducing carbon content in the molten steel, thereafter, heat generating material, such as Alm Si or so forth is added to the molten metal for heating the molten steel by supplying oxygen (2) the molten steel is heated by adding the heat generating material and by supplying oxygen, Al and Si in the molten steel is completely burned, and after completely burning the heat generating material, decarbonization process is performed (3) as proposed in Japanese Patent First Publication (Tokkai) Showa 55-125220, in case of high chromium steel, chromium is oxidized by supplying oxygen for generating a heat for heating the molten steel.

In case of the solution (1) and (2) set forth above, since processing period is separated between a period for performing decarbonization and a period for heating the molten steel, process period is substantially expanded to degrade production efficiency. Particularly, in cause of the solution (1), substantial process time is required for completely combustioning Al and Si in case of high carbon steel. Similarly, in case of solution (2), substantial process period is required simply for completely combustioning Al and Si. Furthermore as a result of combustion, soniums, i.e. $Al_2O_3$ and $SiO_2$, is produced in the montel steel to cause degradation of the quality of the steel to be produced. Furthermore, addition of such heat generating material clearly cause increasing of production cost.

On the other hand, in case of the solution (3), since the content of the steel, such as chromium is consumed for generating heat, yield is clearly lowered.

SUMMARY OF THE INVENTION

Therefore, it is an object of the present invention to provide novel and useful solution in vacuum degassing and decarbonization process which can solve the defects in the prior proposed art.

Another objection of the invention is to provide a degassing and decarbonization process in which temperature drop can be successfully compensated without causing extra cost, expansion of process time, or degradation of the product quality.

In order to accomplish aforementioned and other objects, a process of degassing and decarbonizing according to the present invention, is directed to a process for performing vacuum degassing non-deoxidized or slightly deoxidized molten steel utilizing RH process or DH process. The process includes blowing of oxygen or oxygen containing gas toward the surface of the molten steel in a vacuum chamber for promoting decarbonizing reaction. The process further includes a step of combustioning of CO gas in the vicinity of the surface of the molten metal at a timing, in which concentration of $(CO+CO_2)$ in an exhaust gas is higher than or equal to 5% and a ratio of $CO_2$ versus $(CO+CO_2)$ in the exhaust gas is approximately 30%. Heat generated by combustioning of CO gas is utilized for compensating temperature drop of the molten steel.

Preferably, degree of vacuum upon blowing of oxygen or oxygen containing gas is higher than or equal to 1 Torr. The pressure of oxygen or oxygen containing gas is selected so that the pressure P at the surface of the melt is in a range greater than or equal to 15 and smaller than or equal to 950. The pressure P is illustrated by the following equation:

$$\log_{10}P = -0.808(LH)^{0.7} = 0.00191(PV) + 0.00388(D_2/D_1)^2Q + 2.970$$

wherein

LH is a distance of molten metal in the vacuum chamber from a static molten metal bath m PV is a degree of vacuum in the vacuum chamber reached at the end of blowing of oxygen Torr $D_1$ diameter at the throat of Laval nozzle mm $D_2$ diameter at the outlet of lance chip mm Q: oxygen flow rate $Nm^3/min$ (in case of oxygen containing gas, Q is a converted value into oxygen amount)

In addition, according to the present invention, the degree of vacuum in the vacuum chamber is controlled within a range of 1 Torr to 200 Torr. Furthermore, it is preferred to the position to blowing oxygen is 1.6 m to 4.5 m above the surface of the molten steel bath.

During vacuum degassing and decarbonization process for non-deoxidized or slightly deoxidized molten steel produced by steel making furnace, such as converter, CO gas is generated by chemical reaction of carbon and oxygen. The invention is to supply oxygen gas or oxygen containing gas through a top blowing lance in a condition that flowing of oxygen does not interfere decarbonizing reaction. By supplying oxygen, CO is combustioned to generate a heat. The generated heat is transferred to the molten steel for compensating temperature drop.

As will be appreciated herefrom, the proposed process is differentiated from RH-OB process, in which oxygen is directly blown into molten steel. Namely, according to the invention, oxygen is blown toward the surface of the molten steel. Part of blown oxygen is used for promoting decarbonization. When all of blown oxygen is consumed for decarbonization, heating of motel steel by combustioning CO becomes impossible. Therefore, in order to assure promotion of decarbonization and combustion of CO, height of lance, degree of vacuum, oxygen flow rate, configuration of lance and so forth are to be appropriately controlled. Furthermore, the pressure of oxygen flow has to be appropriately controlled.

According to one aspect of the invention, a process for degassing and decarbonization of molten steel comprises the steps of:

introducing molten steel into a vacuum chamber from a molten steel container performing degassing and decarbonization operation in the vacuum chamber for reducing carbon content in the molten steel providing a lance within the vacuum chamber at an orientation to place discharge end of the lance being placed above a surface of the molten steel in the vacuum chamber with a predetermined distance discharging oxygen or oxygen containing gas through the lance when rate of $(CO+CO_2)$ versus an exhaust gas amount is greater than or equal to 5% and ratio of CO versus $(CO+CO_2)$ is greater than or equal to 30% for combustioning CO in the vicinity of the surface of the molten steel in the vacuum chamber.

The process may further comprise steps of deriving decarbonization amount and allowable temperature drop on the basis of molten steel temperature upon starting of degassing process, initial carbon content in the molten steel, a target molten steel temperature after process and target carbon content in processed molten steel and deriving oxygen or oxygen containing gas supply height, oxygen or oxygen containing gas supply amount and oxygen or oxygen containing gas supply period on the basis of derived decarbonizing amount and the allowable temperature drop.

On the other hand, the step of discharging oxygen or oxygen containing gas may be performed when degree of vacuum in the vacuum chamber is greater than or equal to 1 Torr, in such a manner that the pressure P of oxygen or oxygen containing gas at the surface of the molten steel is within a range of 15 to 950, wherein the pressure P is identified by:

$$\log_{10}P = -0.808(LH)^{0.7} + 0.00191(PV) + 0.00388(D_2/D_1)^2Q + 2.970$$

wherein

LH is a distance of molten metal in the vacuum chamber from a static molten metal bath m PV is a degree of vacuum in the vacuum chamber reached at the end of blowing of oxygen Torr $D_1$ diameter at the throat of Laval nozzle mm $D_2$ diameter at the outlet of lance chip mm Q: oxygen flow rate $Nm^3/min$ (in case of oxygen containing gas, Q is a converted value into oxygen amount)

The oxygen or oxygen containing gas for promoting decarbonization and combustion of CO gas may be discharged through a common lance. In the alternative, the process may include step of providing first and second lances, discharging oxygen or oxygen containing gas through the first lance for promoting decarbonization and discharging oxygen or oxygen containing gas through the second lance for combustioning CO gas generated through decarbonization process. In the former case, the distance between the tip end of lance and the surface of the molten steel may be in a range of 1.6 m to 4.5 m. In the latter case, the first lance is oriented to place the tip end thereof at a position distanced from the static molten steel surface less than or equal to 1.6 m and the second lance is oriented to place the tip end thereof at a position distance from the static molten steel surface in a range of 1.6 m to 4.5 m.

Preferably, the degree of vacuum is controlled within a range of 1 Torr to 200 Torr.

BRIEF DESCRIPTION OF THE DRAWINGS

The present invention will be understood more fully from the detailed description given herebelow and from the accompanying drawings of the preferred embodiment of the invention, which, however, should not be taken to limit the invention to the specific embodiment but are for explanation and understanding only.

In the drawings.

DETAILED DESCRIPTION OF THE INVENTION

Figure 1:
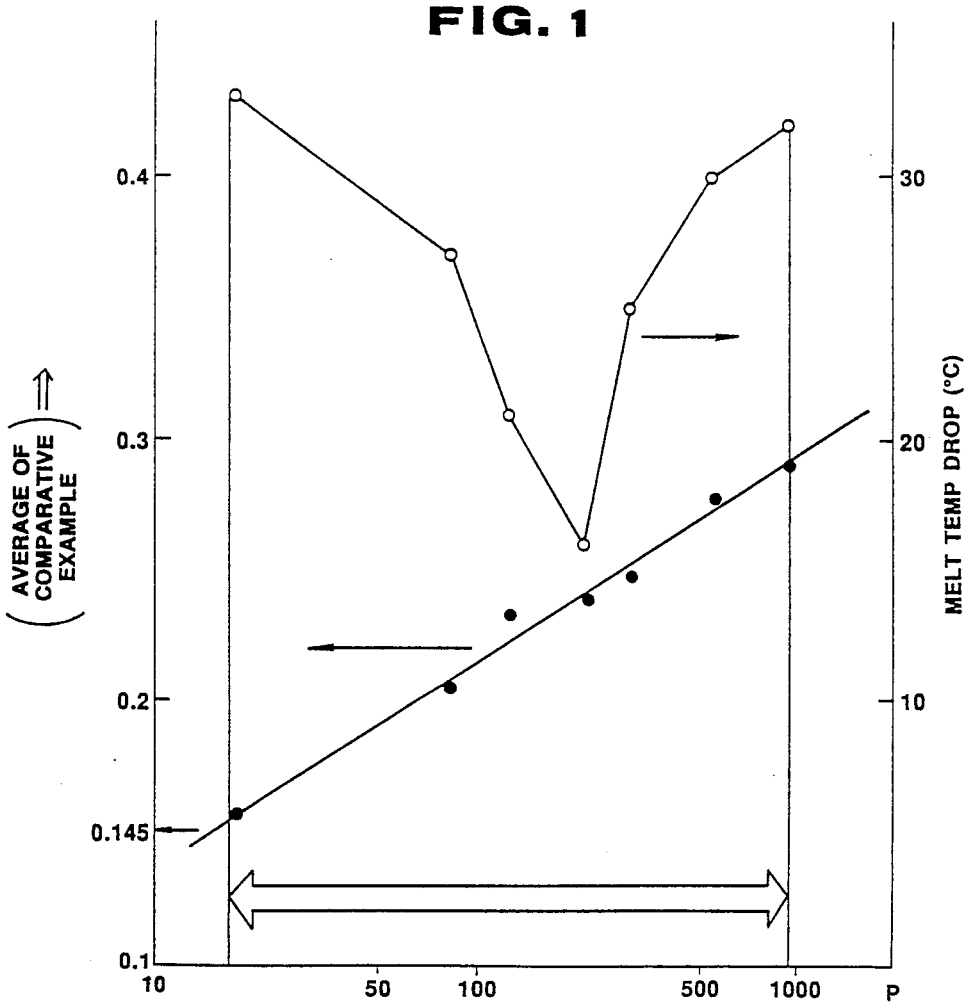
FIG. 1 is a graph showing relationship between degree of vacuum, decarbonization speed constant and temperature drop of the molten steel

As set forth above, effect of supplying oxygen during vacuum degassing process is substantially variable depending upon conditions, such as the height of oxygen supply, degree of vacuum, configuration of lance and oxygen flow rate. Through the disclosure, the word height of oxygen supply is used for representing a distance of the tip end of the lance to a static surface of molten steel introduced into the vacuum chamber. In the preferred process, variation of effect caused by variation of condition is detected by monitoring oxygen pressure P(Torr) at the surface of the molten steel at the center axis of the oxygen flow which correspond to the center axis of the lance. The equation illustrating pressure P is established by obtaining a condition having closest corelation with the resultant pressure obtained through measured at various conditions by varying outlet and throat diameters of the Laval lance and straight nozzle, height of oxygen supply, oxygen flow amount and degree of vacuum. FIG. 1 shows pressure P derived by the foregoing equation in terms of the result of actual operation, decarbonization speed constant during the decarbonization process to decrease carbon content up to 40 ppm, and temperature drop in the molten steel during a period of 15 min. from starting operation.

As seen from FIG. 1, the decarbonization speed constant increases according to increasing of the pressure P. This is because propagation rate of the supplied oxygen into the molten steel is increased according to increasing of the oxygen pressure P at the surface of the molten steel for promoting higher rate of decarbonization. On the other hand, concerning the molten steel temperature drop, magnitude of temperature drop increases according to increasing of the pressure P. This is because that, as set forth, higher pressure P causes increasing of oxygen amount to be consumed for promoting decarbonization and thus decreasing of oxygen amount to be consumed for secondary combustion. On the other hand, when the oxygen pressure P is too low, the heat generated by secondary combustion is exhausted with the exhaust gas as high temperature gas. From this, it is appreciated that, in viewpoint of compensation of temperature drop, it is essential to control the oxygen pressure P at the surface of the molten steel within an appropriate pressure range.

From the results as shown in FIG. 1, in order to achieve the lowest decarbonization speed (0.145) derived from the average value of comparative examples, the oxygen pressure P at the surface of the molten steel is determined at 15. On the other hand, upper limit of the decarbonization speed is set at 11.2 which is decarbonization speed of an example 9 which will be discussed later. In order to achieve this decarbonization speed, i.e. 11.2, the maximum oxygen pressure P is determined at 950.

In the preferred process, the degree of vacuum is set in a range of 1 Torr to 200 Torr. When the degree of vacuum is less than 1 Torr, amount of CO to be generated becomes insufficient to generate enough heat for compensating the temperature drop of the molten steel. Therefore, the degree of vacuum to supply oxygen has to be higher than or equal to 1 Torr. On the other hand, when the degree of vacuum becomes in excess of 200 Torr, sufficient decarbonization cannot be promoted to cause decreasing of amount of CO to be generated. Therefore, similarly to that discussed above, heat to be generated by combustion of reduced amount of CO becomes not sufficient to compensate the temperature drop of the molten steel.

Therefore, in the practical implementation of the invention, blowing of oxygen is started when the degree of vacuum drops below 200 Torr after starting degassing operation. On the other hand, blowing of oxygen is terminated when the degree of vacuum drops below 1 Torr.

The height of oxygen supply is determined to be in a range of 1,6 m to 4.5 m. When the oxygen supply height is less than 1.6 m, greater proportion of supplied oxygen is consumed for promoting decarbonization and thus oxygen amount for cuasing secondary combustion of CO becomes insufficient so as to make temperature compensation insufficient. On the other hand, when the oxygen supply height is in excess of 4.5 m, combustion of CO is caused at an orientation far above the surface of the molten steel so as to substantially lower heat transfer efficiency.

Here, in the apparatus to perform RH vacuum degassing process, the static molten steel bath in the vacuum chamber is generally in a depth of 250 mm to 500 mm. Therefore, the oxygen supply height can be determined with taking this depth of the static molten steel bath into account.

Figure 2:
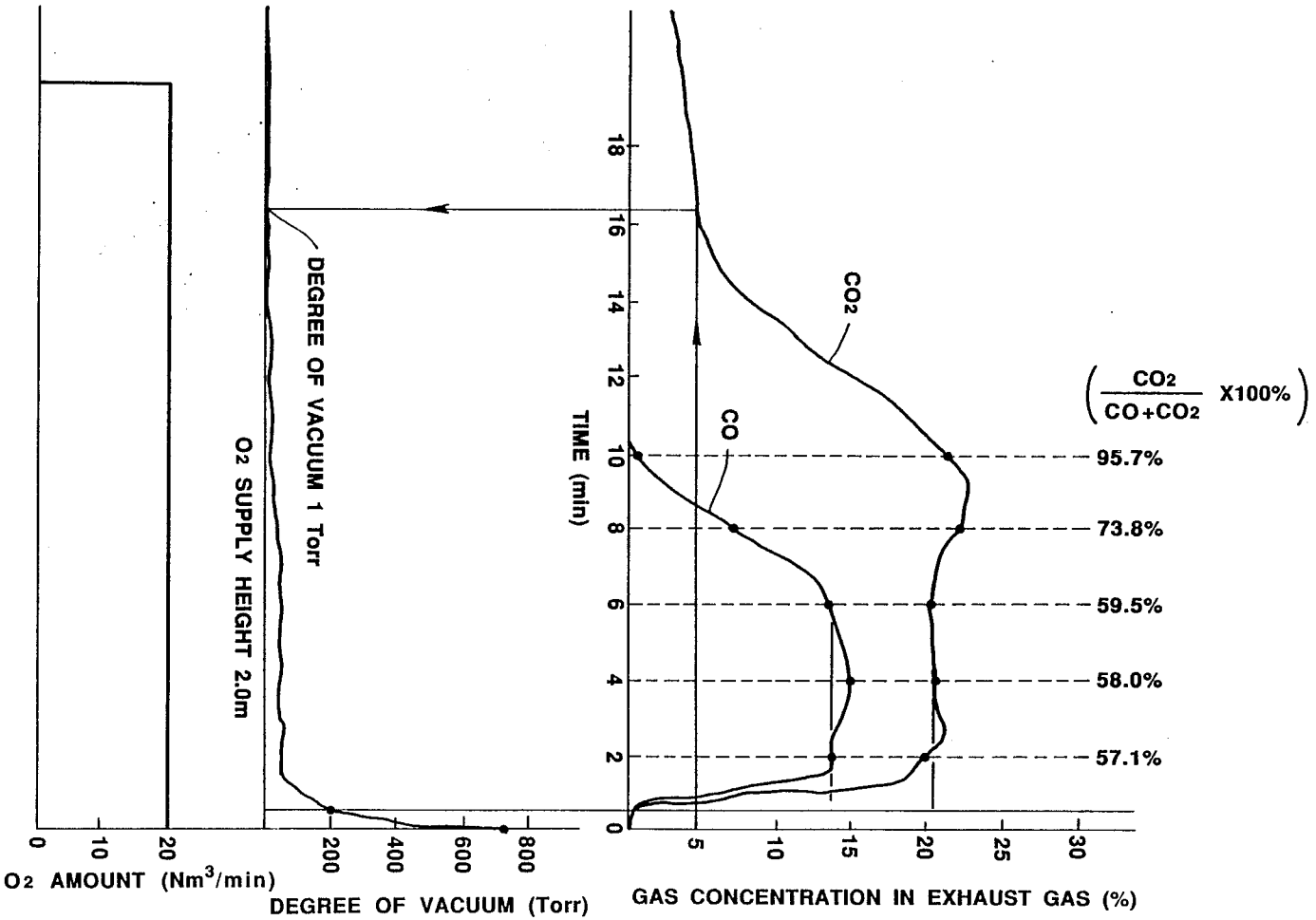
FIG. 2 is a graph showin variation of gas concentration in exhaust gas, degree of vacuum and oxygen flow rate during a period in which oxygen is supplied while experimental implementation of vacuum degassing and decarbonization process according to the present invention

FIG. 2 shows a result of experimental implementation of vacuum degassing process utilizing RH process with supplying oxygen. Experimental process was performed for molten steel contained C: 0.056% Si: 0.02% and Mn: 0.28%. Oxygen concentration of the molten steel was 358 ppm. The temperature of the molten steel was 1588° C. On the other hand, FIG. 2 shows a results of comparative implementation of vacuum degassing process which was performed without supplying oxygen. Experimental process was performed for molten steel contained C: 0.035% Si: Tr% and Mn: 0.27%. Oxygen concentration of the molten steel was 411 ppm. The temperature of the molten steel was 1592° C.

Figure 3:
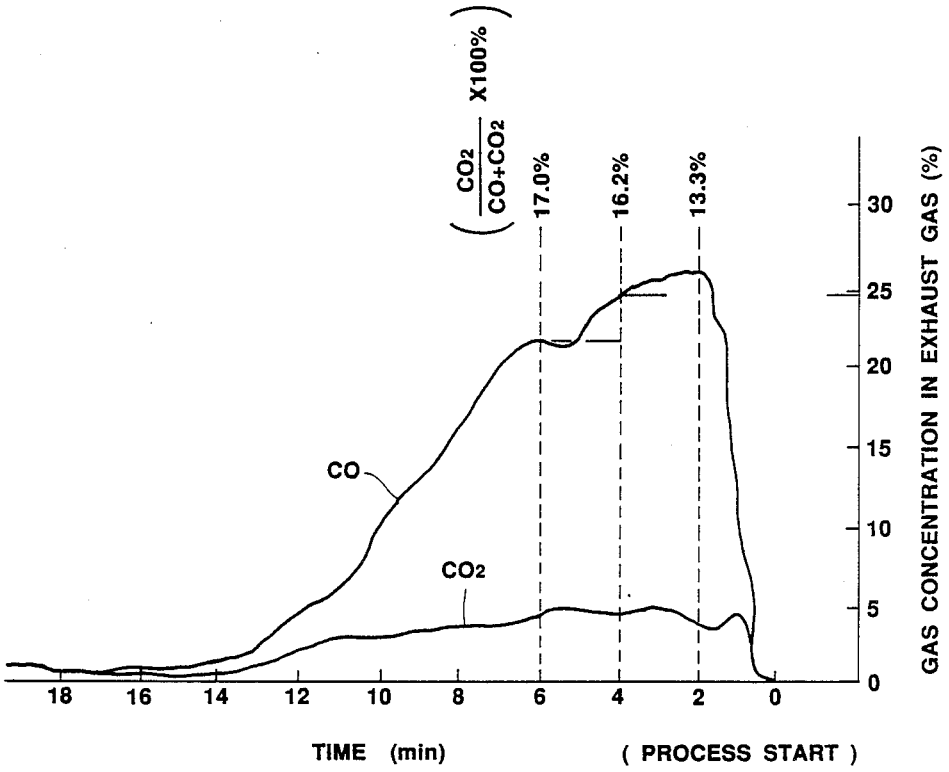
FIG. 3 is a graph showing variation of gas concentration in exhaust gas during degassing process

As can be seen from FIG. 2, by supplying oxygen into the vacuum chamber, substantially high secondary combustion rate ($CO_2/(CO+CO_2)\times 100\%$ ) can be obtained. As seen from FIG. 2, when the degree of vacuum is in excess of 200 Torr, CO gas is not generated. Therefore, even by supplying oxygen, combustion will never been occurs. According to progress of vacuum degassing process, the gas ($CO+CO_2$) concentration is once increased after the degree of vacuum is reduced to be lower than 200 Torr and subsequently decreased. The degree of vacuum is accordingly decreased to 1 Torr or less. At the degree of vacuum 1 Torr, the ($CO+CO_2$) gas concentration is becomes approximately 5% or less. This gas concentration (i.e. 5% ) is approximately equal to the $CO_2$ concentration in FIG. 3. As will be appreciated from this, at the degree of vacuum 1 Torr, almost no CO gas is combustioned to generate a temperature drop compensating heat. Therefore, in order to optimize degassing efficiency and heating efficiency, oxygen is to be supplied when the degree of vacuum is in a range of 1 Torr to 200 Torr.

Figure 4:
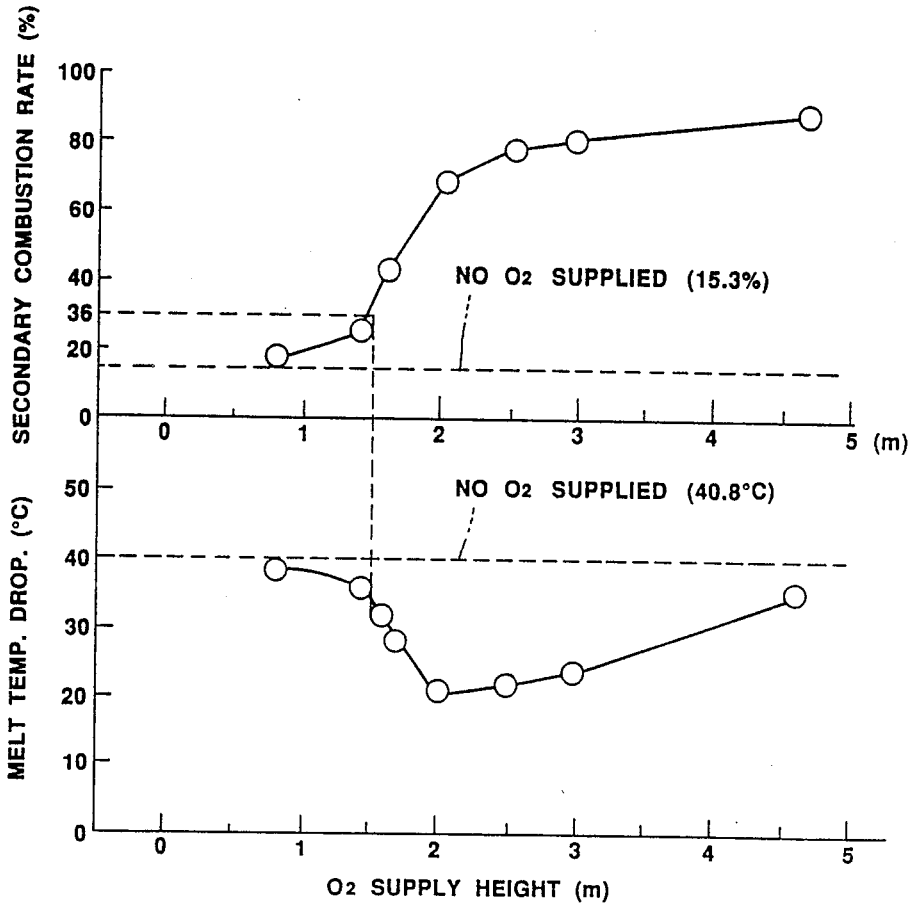
FIG. 4 is a graph showing relationship between a oxygen supply height, temperature drop in the molten steel and secondary combustion

FIG. 4 shows variation of secondary combustion rate which is derived as an average value within a period 2 minutes after starting process to 8 minutes after starting process and of molten steel temperature from start of process to 15 minutes therefrom, in relation to oxygen supply height. As can be seen from FIG. 4, the secondary combustion rate is increased according to increasing of the oxygen supply height. On the other hand, when the secondary combustion rate is less than 30%, noticeable compensation of temperature drop cannot be observed. In contrast to this, substantial compensation of the temperature drop can be observed when the secondary combustion rate is higher than or equal to 30%. Therefore, in order to effectively compensate temperature drop, it is required to provide secondary combustion rate higher than or equal to 30%.

In the vacuum degassing and decarbonization process, it is essential to achieve target molten steel temperature, target carbon concentration on the molten steel at the end of process. Therefore, before starting degassing and decarbonization process, carbon amount and allowable temperature drop is derived in view of the target values and actual values of molten metal temperature and carbon amount in the molten metal supplied to the ladle. According to the derived amount of carbon to be removed and allowable temperature drop, the oxygen supply height and oxygen or oxygen containing gas flow supply amount and supply period is determined.

In practice, the amount of carbon to be removed can be derived from the following equation:

$$Q_{O2-I}=\Delta C\times 11.2/12-\Delta O$$

$$\Delta O=\omega_1\times\Delta C+\omega_2(\Delta C>0) \quad (1)$$

wherein $Q_{O2-I}$: required amount ($Nm^3$) of oxygen to be blown from the top for removing an amount $\Delta C$ of carbon $\Delta C$: target decarbonizing amount (kg)

$\Delta O$: amount of oxygen in the molten steel to be consumed for decarbonization for achieving target decarbonization amount $\Delta C$ $\omega_1$: a proportioning constant (0 through 2000) representative of proportion of amount of oxygen in the molten steel to be consumed for decarbonization for achieving target decarbonization amount with blowing oxygen through the top $\omega_2$: a constant (0 to 10 $Nm^3$) representative of amount of oxygen in the molten steel to be consumed for a factor other than decarbonization and thus is not proportional to $\Delta C$.

Also, amount of oxygen required for secondary combustion is derived according to the following equation (2):

$$Q_{O2-II}=\Delta C\times 11.2/12\times(CO_2/(CO+CO_2))S \quad (2)$$

wherein $Q_{O2-II}$: amount of top blown oxygen amount for secondary combustion during decarbonization for achieving the target decarbonization amount $\Delta C$. Here, the secondary combustion rate $\{CO_2/(CO+CO_2)\}S$ can be illustrated by the following equation (3):

$$(CO_2/(CO+CO_2))=a\times(L.H.s.-b)^x+c \quad (3)$$

wherein

L.H.s: oxygen supply height a and b: proportioning constants (−10 through 10) of secondary combustion rate, which is variable depending upon the oxygen supply height c: a constant term (0 through 1) of secondary combustion rate, which is variable depending upon oxygen supply height and x: exponent showing functional relationship between the oxygen supply height and secondary combustion rate.

As clear from the above, the secondary combustion rate is determined depending upon the oxygen supply height. Furthermore, from the foregoing equations (1) and (2), the necessary oxygen amount $Q_{O2}$ is illustrated by the following equation (4):

$$Q_{O2}=Q_{O2-I}+Q_{O2-II}+Q' \quad (4)$$

Wherein

Q': amount ($Nm^3$) of oxygen to be exhausted with exhaust gas, O<C $\theta_1$ and $\theta_2$: proportional constant representative of influence of oxygen supply height for oxygen amount to be exhausted with exhaust gas and $\theta_3$: exponent representative of influence of oxygen supply height for oxygen amount to be exhausted with exhaust gas.

On the other hand, a temperature drop preventive factor $\eta$ can be illustrated by:

$$\eta=\xi\times F_{O2}\times(CO_2/(CO+CO_2))Sx(p/L.H.s)^q \quad (5)$$

wherein $\xi$: a proportioning constant (0.1 through 20) of temperature drop preventive factor (°C/min) variable depending upon oxygen supply speed $F_{O2}$: average oxygen supply speed, ($F_{O2}=Q_{O2}/t_{O2}$)

p: constant (0.1 through 10) representative of influence of oxygen supply height for heating ability q: a exponent (0.05 through 10) representative of influence of oxygen supply height for heating ability.

$Q_{O2}$: necessary oxygen amount ($Nm^3$)

$t_{O2}$: necessary oxygen supply period (min).

Assuming the allowable temperature drop is $\Delta T$, the necessary oxygen supply period $t_{O2}$ can be illustrated by:

$$t_{O2}=\{\Delta T+dT_R-e\ O_i\}/\eta$$

wherein $T_R$: standard rimmed processing period (min)

d: temperature drop (°C/min) of molten steel during rimmed processing and e: constant (0 through 2) representative of degree of effect of free oxygen concentration in the molten steel for temperature variation.

As will be appreciated herefrom by setting the standard oxygen supply height L.H.s and oxygen supply speed $F_{O2}$, the necessary oxygen supply period $t_{O2}$ can be determined for assurance of achievement of the target molten steel temperature and carbon amount.

Figure 5:
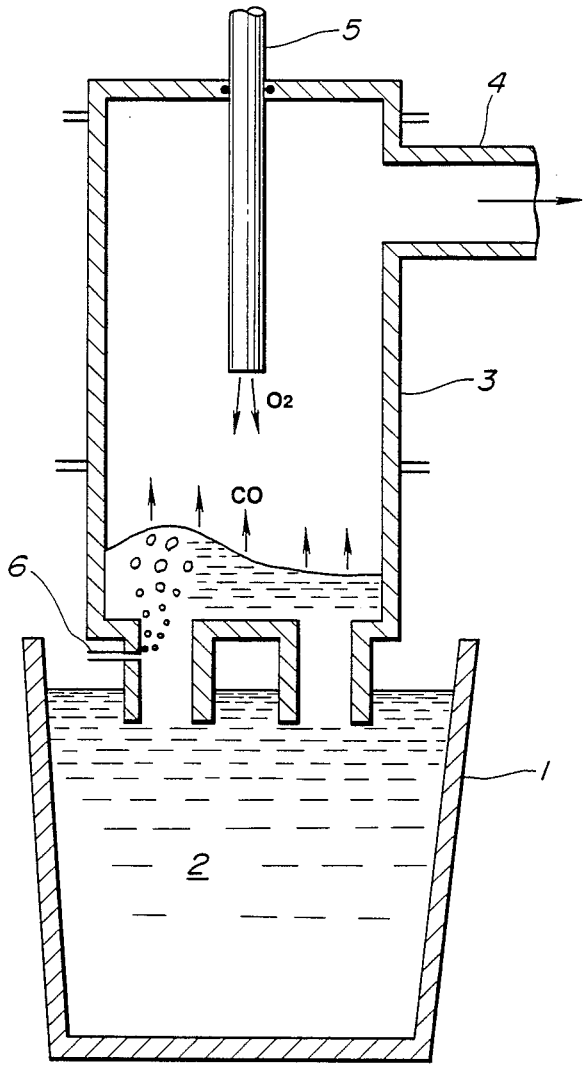
FIGS. 5 and 6 are explanatory illustrations of RH closed circuit vacuum degassing apparatus, for which the preferred process of degassing and decarbonization is applicable.
Figure 6:
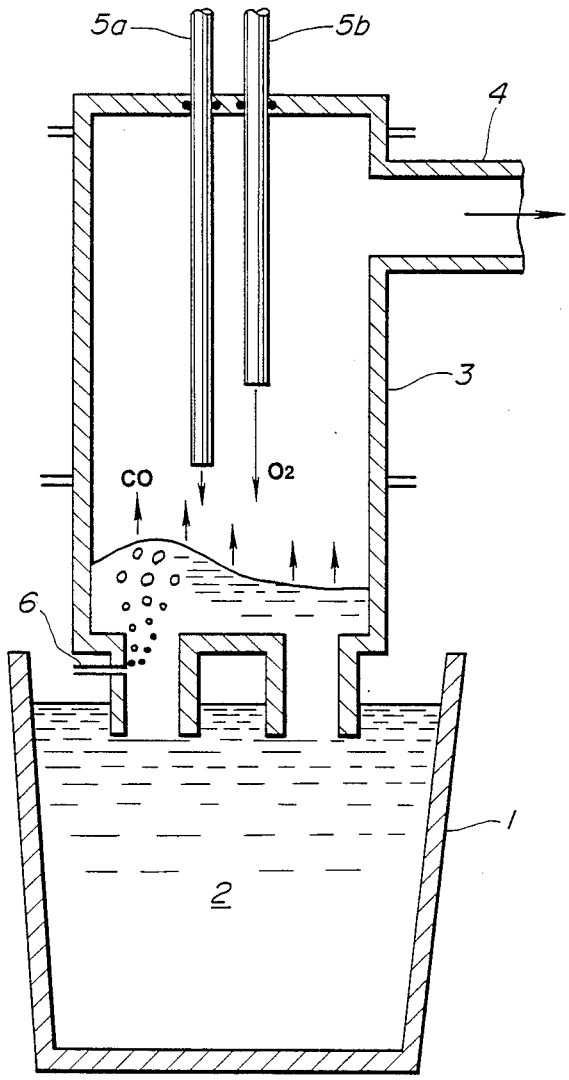

A set forth, in order to practically implement the preferred process according to the present invention, RH vacuum degassing apparatus can be utilized. FIGS. 5 and 6 are explanatory illustrations of RH degassing apparatus which are useful for implementing the preferred degassing and decarbonization process according to the invention. The apparatus defines a vacuum or degassing chamber 3 communicated with ladle 1, in which is filled molten steel 2, with a suction path 3a and a return path 3b. The vacuum chamber 3 is also communicated with an exhast duct 4 in order to exhausting the exhaust gas generated during degassing and decarbonization process.

A lance 5 is inserted into the vacuum chamber. As can be seen from FIG. 5, the tip end of the lance 5 is oriented above the surface of the molten steel bath. The orientation of the tip end of the lance 5 is determined with respect to the molten steel bath according to the oxygen supply height which is determined through the process set forth above. An inert gas supply tuyere 6 is provided through the wall defining the suction path 3*a* for sucking the molten steel in the ladle 1 to the vacuum chamber.

In the shown construction, oxygen is supplied through the lance 5 for promoting degassing reaction and combustioning CO gas generated during degassing and decarbonization process.

In the construction, by appropriately controlling the oxygen supply speed and supply period, optimum degassing and decarbonization efficiency can be obtained and, as well, reduction of temperature drop can be achieved.

In FIG. 6, another construction of the degassing apparatus is proposed. In the shown construction, two mutually separate lances 5*a* and 5*b* are inserted into the vacuum chamber 3. The lance 5*a* has the tip end oriented close to the molten steel surface. The other lance 5*b* has the tip end oriented at higher position than that of the lance 5*a*. The orientation of the latter lance 5*b* is determined to be within a range of 1.6 m to 4.5 m from the molten steel surface. By this construction, oxygen blown through the lance 5*a* is well propagated within the molten steel in the vacuum chamber for promoting degassing and decarbonization. On the other hand, the oxygen blown through the lance 5*b* is mainly consumed for combustion of CO gas generated in the degassing and decarbonization process for successfully compensate temperature drop of the molten steel.

The construction of FIG. 6 may be advantageous for permitting oxygen amount to be consumed for promoting degassing and decarbonization and for combustion of CO gas.

EXAMPLE 1

230 tons of molten steel containing 0.02 to 0.05% of C was produced by means of bottom blown converter. The degassing and decarbonization process was performed utilizing RH closed circuit vacuum degassing apparatus for 230 tons of molten steel. Degassing and Decarbonizing operation was performed according to the condition as shown in the appended table I. During degassing and decarbonizing process, molten steel temperature was checked. The result is also shown in the table I.

As can be seen from the table I, through No. 1 to No. 9 heats, the secondary combustion were occurred to combustion CO. By this, temperature drop was successfully compensated. As a result, the average temperature drop ΔT over No. 1 to No. 9 heat was 25.3° C. This is much smaller than that in the conventional process, in which average temperature drop was 40.8° C. Therefore, difference of temperature drop between the invention and the conventional process was 15.5° C. The No. 10, 11 and 12 heats were performed with the oxygen supply height out of the preferred range, i.e. 1.6 m to 4.5 m. Though the temperature drop in these heats were greater than that in No. 1 to No. 9 heats, it is still smaller than that of the conventional process as shown as No. 13 heat.

EXAMPLE 2

By utilizing the apparatus for 230 tons of molten steel and having construction as shown in FIG. 6, degassing and decarbonization process was performed according to the conditions shown in the appended table II. During degassing and decarbonization process, temperature drop and decarbonizing speed were monitored. In this experiments, the oxygen supply heights of the lance 5*a* was set at 0.8 m and the lance 5*b* was set in arrange of 2.0 m to 3.0 m. The oxygen supply amount through each lance was set at 20 $Nm^3$/min (total 40 $Nm^3$/min). The results are also shown in the table II.

As can be seen from the table II, successfully high decarbonization speed and small temperature drop was achieved in the experiments.

While the present invention has been disclosed in terms of the preferred embodiment in order to facilitate better understanding of the invention, it should be appreciated that the invention can be embodied in various ways without departing from the principle of the invention. Therefore, the invention should be understood to include all possible embodiments and modifications to the shown embodiments which can be embodied without departing from the principle of the invention set out in the appended claims.

Though the preferred process has been discussed in terms of RH degassing and decarbonization process, the invention is applicable not only for RH process but also for DH process.

TABLE 1

| | | | Before Process | | Target | | Calculated | $O^2$ Supply Amount | $CO_2/(CO + CO_2)$ | |
|---|---|---|---|---|---|---|---|---|---|---|
| | Heat No. | Charged Al | O (ppm) | C (ppm) | C (ppm) | ΔC (kg) | ΔO ($Nm^3$) | (Calculated) ($Nm^3$) | Average, Actually Measured | Calculated |
| INVENTION A | 1 | NO | 378 | 421 | 18 | 92.7 | 15.1 | 139.2 | 0.60 | 0.585 |
| | 2 | YES | 407 | 356 | 18 | 77.7 | 12.7 | 117.9 | 0.59 | 0.585 |
| | 3 | YES | 465 | 282 | 18 | 60.7 | 10.0 | 106.3 | 0.68 | 0.669 |
| | 4 | YES | 482 | 256 | 15 | 55.4 | 9.2 | 120.9 | 0.74 | 0.739 |
| | 5 | NO | 465 | 342 | 20 | 74.1 | 12.2 | 126.5 | 0.65 | 0.669 |
| | 6 | YES | 483 | 233 | 15 | 50.1 | 8.3 | 112.6 | 0.73 | 0.739 |
| | 7 | NO | 317 | 503 | 20 | 111.1 | 18.1 | 182.3 | 0.66 | 0.669 |
| | 8 | NO | 333 | 478 | 20 | 105.3 | 17.1 | 173.6 | 0.67 | 0.669 |
| | 9 | NO | 397 | 401 | 20 | 87.6 | 14.3 | 194.4 | 0.79 | 0.786 |
| INVENTION B | 10 | NO | 353 | 451 | 15 | 100.3 | 16.3 | 130.6 | 0.15 | 0.152 |
| | 11 | NO | 376 | 423 | 15 | 193.8 | 15.3 | 122.7 | 0.22 | 0.211 |
| | 12 | NO | 421 | 378 | 20 | 82.3 | 13.5 | 244.3 | 0.88 | 0.890 |
| COMPARATIVE | 13 | NO | 459 | 356 | 15 | — | — | — | 0.15 | — |
| | 14 | YES | 507 | 286 | 18 | — | — | — | 0.16 | — |
| | 15 | NO | 471 | 338 | 20 | — | — | — | 0.14 | — |
| | 16 | YES | 532 | 252 | 18 | — | — | — | 0.16 | — |
| | 17 | YES | 586 | 232 | 18 | — | — | — | 0.16 | — |
| | 18 | NO | 454 | 351 | 20 | — | — | — | 0.15 | — |

Period to

Decarbonization speed

TABLE 1-continued

| | Heat No. | Reach C = 40 ppm (min) | $O_2$ Top blowing Period (min) Actually Measured | Calculated | Degree of Vacuum At Start of $O_2$ Supply (Torr) | At end of $O_2$ Supply (Torr) | Final C Content (ppm) | constant upto C = 40 ppm (1/min) |
|---|---|---|---|---|---|---|---|---|
| INVENTION A | 1 | 9.5 | 7.4 | 7.0 | 190 | 10 | 16 | 0.248 |
| | 2 | 9.1 | 6.7 | 5.9 | 190 | 13 | 17 | 0.240 |
| | 3 | 8.6 | 5.7 | 5.3 | 200 | 7 | 16 | 0.227 |
| | 4 | 8.0 | 5.5 | 6.0 | 180 | 5 | 14 | 0.232 |
| | 5 | 9.0 | 6.3 | 6.3 | 185 | 11 | 19 | 0.238 |
| | 6 | 7.6 | 5.1 | 5.6 | 190 | 8 | 15 | 0.232 |
| | 7 | 10.2 | 8.2 | 9.1 | 190 | 20 | 18 | 0.248 |
| | 8 | 9.8 | 7.8 | 8.7 | 200 | 18 | 19 | 0.253 |
| | 9 | 11.2 | 10.0 | 9.7 | 190 | 13 | 20 | 0.205 |
| INVENTION B | 10 | 8.3 | 5.8 | 6.5 | 200 | 20 | 13 | 0.291 |
| | 11 | 8.2 | 6.9 | 6.1 | 200 | 15 | 12 | 0.288 |
| | 12 | 14.2 | 12.0 | 12.2 | 200 | 10 | 19 | 0.158 |
| COMPARATIVE | 13 | 14.5 | 6.0 | — | 0.9 | 0.4 | 13 | 0.150 |
| | 14 | 13.8 | — | — | — | — | 18 | 0.143 |
| | 15 | 15.0 | — | — | — | — | 20 | 0.142 |
| | 16 | 12.6 | — | — | — | — | 17 | 0.146 |
| | 17 | 11.9 | — | — | — | — | 16 | 0.148 |
| | 18 | 15.3 | — | — | — | — | 21 | 0.142 |

| | Heat No. | Oxygen Supply Height (m) | Molten Steel Temp. Upon Start Process (°C.) | Molten Steel Temp. After 15 min Process (°C.) | Temperature Drop (ΔT) Actually Measured (°C.) | Target (°C.) | TR (min) | Temperature Drop Prevention Ability (°C./min) | Lance $D_1$ (mm) | $D_2$ (mm) | P |
|---|---|---|---|---|---|---|---|---|---|---|---|
| INVENTION A | 1 | 1.7 | 1605 | 1580 | 25 | 24 | 15.0 | 1.66 | 18 | 52.5 | 300 |
| | 2 | 1.7 | 1603 | 1575 | 28 | 25 | 15.0 | 1.66 | 20 | 52.5 | 228 |
| | 3 | 2.0 | 1605 | 1580 | 25 | 26 | 15.0 | 1.64 | 20 | 52.5 | 161 |
| | 4 | 2.5 | 1603 | 1582 | 21 | 23 | 18.0 | 1.48 | 18 | 52.5 | 127 |
| | 5 | 2.0 | 1601 | 1585 | 16 | 21 | 24.0 | 1.64 | 18 | 52.5 | 218 |
| | 6 | 2.5 | 1604 | 1578 | 26 | 25 | 18.0 | 1.48 | 18 | 52.5 | 129 |
| | 7 | 2.0 | 1607 | 1583 | 24 | 24 | 15.0 | 1.64 | 16 | 52.5 | 340 |
| | 8 | 2.0 | 1605 | 1588 | 17 | 20 | 20.0 | 1.64 | 16 | 52.5 | 337 |
| | 9 | 3.0 | 1600 | 1573 | 27 | 26 | 15.0 | 1.34 | 18 | 52.5 | 82 |
| INVENTION B | 10 | 0.8 | 1615 | 1583 | 32 | 30 | 15.0 | 0.85 | 18 | 52.5 | 949 |
| | 11 | 1.2 | 1614 | 1582 | 30 | 32 | 15.0 | 0.82 | 18 | 52.5 | 551 |
| | 12 | 4.7 | 1612 | 1579 | 33 | 29 | 15.0 | 1.01 | 18 | 52.5 | 18 |
| COMPARATIVE | 13 | 0.8 | 1620 | 1582 | 38 | 37 | — | — | 20 | 20 | 228 |
| | 14 | — | 1620 | 1580 | 40 | 39 | — | — | | | |
| | 15 | — | 1625 | 1580 | 45 | 45 | — | — | | | |
| | 16 | — | 1618 | 1581 | 37 | 38 | — | — | | | |
| | 17 | — | 1515 | 1576 | 39 | 38 | — | — | | | |
| | 18 | — | 1624 | 1578 | 46 | 45 | — | — | | | |

Process Condition
① 230 tons/heat
② $\omega_1 = 0.16$, $\omega_2 = 0.3$
③ TR = 15 (arithmetically set time)
④ x = 0.33, a = 0.31, b = 1.6, C = 0.44 [1.6 m ≦ oxygen supply height ≦ 5.0 m]; x = 0.33, a = 0.31, b = 1.6, c = 0.44 [0.8 m ≦ oxygen supply height < 1.6 m]
⑤ $\zeta = 0.142$
⑥ d = 0.7, e = 0.059 (1.6 m ≦ oxygen supply height ≦ 4.5 m); d = 0.5, e = 0.090 (oxygen supply height < 1.6 m); d = 0.6, e = 0.060 (oxygen supply height > 4.5 m)
⑦ Q' = −15.0 (oxygen supply height − 1.0) ($\theta_1 = 15$, $\theta_2 = 1.0$, $\theta_3 = 1.8$; oxygen supply height ≧ 1.3 m)
⑧ Q' = 35.0 (1.5 − oxygen supply height) ($\theta_1 = 35.0$, $\theta_2 = 1.5$, $\theta_3 = 0.3$; oxygen supply height < 1.3 m)
⑨ p = 1.7, q = 0.9

TABLE II

| Heat No. | Charged Al | Before Process O (ppm) | C (ppm) | Period to Reach C = 40 ppm (min) | $O_2$ Top Blowing Period (min) | Degree of Vacuum At Start of $O_2$ Supply (Torr) | At End of $O_2$ Supply (Torr) | Final C Content (ppm) | Decarbonization Speed Constant upto C = 40 ppm (1/min) |
|---|---|---|---|---|---|---|---|---|---|
| 19 | NO | 333 | 478 | 7.9 | 6.0/9.5 | 200 | 2 | 13 | 0.314 |
| 20 | NO | 318 | 501 | 7.8 | 7.0/9.8 | 200 | 1 | 12 | 0.324 |
| 21 | NO | 395 | 403 | 7.9 | 5.8/8.2 | 200 | 3 | 13 | 0.292 |

| Heat No. | Oxygen Supply Height (m) | Molten Steel Temp. upon Start Process (°C.) | Molten Steel Temp. after 15 min. Process (°C.) | Temperature Drop (ΔT) (°C.) | Lance for Decarbonization D1 | D2 | P | Lance for Secondary Combustion D1 | D2 | P |
|---|---|---|---|---|---|---|---|---|---|---|
| 19 | 0.8/2.5 | 1601 | 1583 | 18 | 18 | 52.5 | 877 | 20 | 20 | 33 |
| 20 | 0.8/2.0 | 1605 | 1590 | 15 | 18 | 52.5 | 877 | 20 | 20 | 55 |

TABLE II-continued

| | | | | | | | | | | |
|---|---|---|---|---|---|---|---|---|---|---|
| 21 | 0.8/3.0 | 1605 | 1585 | 20 | 20 | 20 | 230 | 18 | 52.5 | 78 |

What is claimed is:

1. A process for degassing and decarbonization of molten steel comprising the steps of:

introducing molten steel into a vacuum chamber from a molten steel container performing degassing and decarbonization operation in said vacuum chamber for reducing carbon content in said molten steel providing a lance within said vacuum chamber at an orientation to place discharge end of said lance being placed above a surface of said molten steel in said vacuum chamber with a predetermined distance discharging oxygen or oxygen containing gas through said lance when rate of ($CO+CO_2$) versus an exhaust gas amount is greater than or equal to 5% and ratio of CO versus ($CO+CO_2$) is greater than or equal to 30% for combustioning CO in the vicinity of the surface of said molten steel in said vacuum chamber.

2. A process as set forth in claim 1, which further comprises steps of deriving decarbonization amount and allowable temperature drop on the basis of molten steel temperature upon starting of degassing process, initial carbon content in said molten steel, a target molten steel temperature after process and target carbon content in processed molten steel and deriving oxygen or oxygen containing gas supply height, oxygen or oxygen containing gas supply amount and oxygen or oxygen containing gas supply period on the basis of derived decarbonizing amount and the allowable temperature drop.

3. A process as set forth in claim 1, wherein said step of discharging oxygen or oxygen containing gas is performed when degree of vacuum in said vacuum chamber is greater than or equal to 1 Torr, in such a manner that the pressure P of oxygen or oxygen containing gas at the surface of said molten steel is within a range of 15 to 950, wherein said pressure P is identified by:

$$\log_{10}P = -0.808(LH)^{0.7} + 0.00191(PV) + 0.00388(D_2/D_1)^2Q + 2.970$$

wherein

LH is a distance of molten metal in the vacuum chamber from a static molten metal bath m PV is a degree of vacuum in the vacuum chamber reached at the end of blowing of oxygen Torr $D_1$ diameter at the throat of Laval nozzle mm $D_2$ diameter at the outlet of lance chip mm Q: oxygen flow rate $Nm^3$/min (in case of oxygen containing gas, Q is a converted value into oxygen amount).

4. A process as set forth in claim 3, wherein oxygen or oxygen containing gas for promoting decarbonization and combustion of CO gas is discharged through a common lance.

5. A process as set forth in claim 4, which includes step of providing first and second lances, discharging oxygen or oxygen containing gas through said first lance for promoting decarbonization and discharging oxygen or oxygen containing gas through said second lance for combustioning CO gas generated through decarbonization process.

6. A process as set forth in claim 3, wherein degree of vacuum is controlled within a range of 1 Torr to 200 Torr.

7. A process as set forth in claim 3, wherein the distance between said tip end of lance and said surface of the molten steel is in a range of 1.6 m to 4.5 m.

8. A process as set forth in claim 5, wherein said first lance is oriented to place the tip end thereof at a position distanced from the static molten steel surface less than or equal to 1.6 m and said second lance is oriented to place the tip end thereof at a position distanced from the static molten steel surface in a range of 1.6 m to 4.5 m.

* * * * *

UNITED STATES PATENT AND TRADEMARK OFFICE

CERTIFICATE OF CORRECTION

PATENT NO. : 4979983

DATED : December 25, 1990

INVENTOR(S) : NISHIKAWA *et al.*

It is certified that error appears in the above-identified patent and that said Letters Patent is hereby corrected as shown below:

Claim 1, line 17, delete "CO", first occurrence, and insert --$CO_2$--

Signed and Sealed this

Twenty-second Day of September, 1998

*Attest:*

Bruce Lehman

BRUCE LEHMAN

*Attesting Officer*

*Commissioner of Patents and Trademarks*